United States Patent [19]

Petracchi

[11] Patent Number: 4,643,339

[45] Date of Patent: Feb. 17, 1987

[54] APPARATUS FOR MANIPULATING A PROTECTIVE TUBE FOR A JET OF MOLTEN METAL

[75] Inventor: Patrice Petracchi, St. Maur des Fosses, France

[73] Assignee: Fives-Cail Babcock, Paris, France

[21] Appl. No.: 714,819

[22] Filed: Mar. 22, 1985

[30] Foreign Application Priority Data

Apr. 4, 1984 [FR] France ..... 84 05287

[51] Int. Cl.[4] ..... B22D 41/08; B25J 9/02

[52] U.S. Cl. ..... 222/607; 164/337; 901/16; 414/590

[58] Field of Search ..... 222/607, 600, 606; 164/337, 437, 438; 266/226, 236; 901/16; 414/744 R, 590, 744 A

[56] References Cited

U.S. PATENT DOCUMENTS

| | | | |
|---|---|---|---|
| 3,033,059 | 5/1962 | Melton et al. | 414/744 X |
| 3,665,148 | 5/1972 | Yasenchak et al. | 901/16 X |
| 4,131,220 | 12/1978 | Bode, Jr. et al. | 164/337 X |
| 4,227,851 | 10/1980 | Beezer | 414/744 A X |
| 4,316,561 | 2/1982 | Grosko | 222/607 X |
| 4,381,102 | 4/1983 | King | 222/607 X |
| 4,433,755 | 2/1984 | Ohtomi | 187/20 |
| 4,460,302 | 7/1984 | Moreau et al. | 414/590 X |
| 4,550,867 | 11/1985 | Bell et al. | 222/607 |

*Primary Examiner*—Joseph J. Rolla
*Assistant Examiner*—Nils Pedersen
*Attorney, Agent, or Firm*—Kurt Kelman

[57] ABSTRACT

An automated apparatus for manipulating a protective tube for a jet of a molten metal discharged from a tap hole of a casting ladle for selective movement of the protective tube under the tap hole and retraction therefrom, uses a first carriage displaceable along a horizontal track, a vertical shaft connected to the first carriage for displacement therewith and rotatable about its longitudinal axis, and a second carriage vertically displaceable along the shaft. A carrier arm for the tube is supported on the second carriage and a support case connects the carrier arm to the second carriage to allow horizontal movements of the carrier arm with respect to the second carriage. The carrier arm can be locked in a predetermined position with respect to the second carriage and is capable of gripping the tube.

8 Claims, 3 Drawing Figures

APPARATUS FOR MANIPULATING A PROTECTIVE TUBE FOR A JET OF MOLTEN METAL

The present invention relates to an apparatus for manipulating a protective tube for a jet of a molten metal discharged from a container, more particularly from a tap hole of a casting ladle, for selective movement of the protective tube under the tap hole and retraction therefrom.

Such protective tubes are designed to be immersed into molten metal in another container, such as a distributor for the discharged molten metal disposed under the first-named container. Whatever its intended use, it has the important task of protecting the jet of molten metal from oxidation, which would be produced by ambient air during its passage from one container to the other. Particularly considering the severe thermal conditions to which these protective tubes are subjected, they are worn out rapidly. Therefore, they must be replaced by new or cleaned tubes at rather frequent intervals.

Therefore, a manipulating apparatus of this type must be able to service several stations, i.e. an operating station, a station where new tubes are stocked and a tube cleaning station, while requiring no substantial human intervention while being manipulated underneath the casting ladle. The tap hole of the ladle is closed by a slide valve during the manipulation of the protective tube and this must be effected in the shortest possible time to prevent an interruption of a continuous casting operation, for example, taking into consideration the capacity of the distributor (the container under the container from which the molten metal is discharged) to assure a continuous delivery of molten metal to the casting mold.

Known protective tube manipulating apparatus does not meet all of the above requirements.

It is accordingly a primary object of this invention to overcome the disadvantages of conventional protective tube manipulating apparatus and to provide such an apparatus whose operations are fully automated, except for the final positioning of the protective tube by human intervention.

The above and other objects are accomplished according to the invention with an apparatus which comprises a first carriage displaceable along a horizontal track, a vertical shaft having a longitudinal axis and connected to the first carriage for displacement therewith, and means for rotating the vertical shaft about the longitudinal axis thereof. A second carriage is vertically displaceable along the shaft and entrainment means is operable to displace the second carriage vertically. A counterweight maintains the second carriage in position when the entrainment means is not operated. A carrier arm for the protective tube is supported on the second carriage, and the carrier arm has means for gripping the protective tube.

The above and other objects, advantages and features of the present invention will become more apparent from the following detailed description of a now preferred embodiment thereof, taken in conjunction with the accompanying drawing wherein FIG. 1 is a side elevational view of the apparatus;

Figure 1:
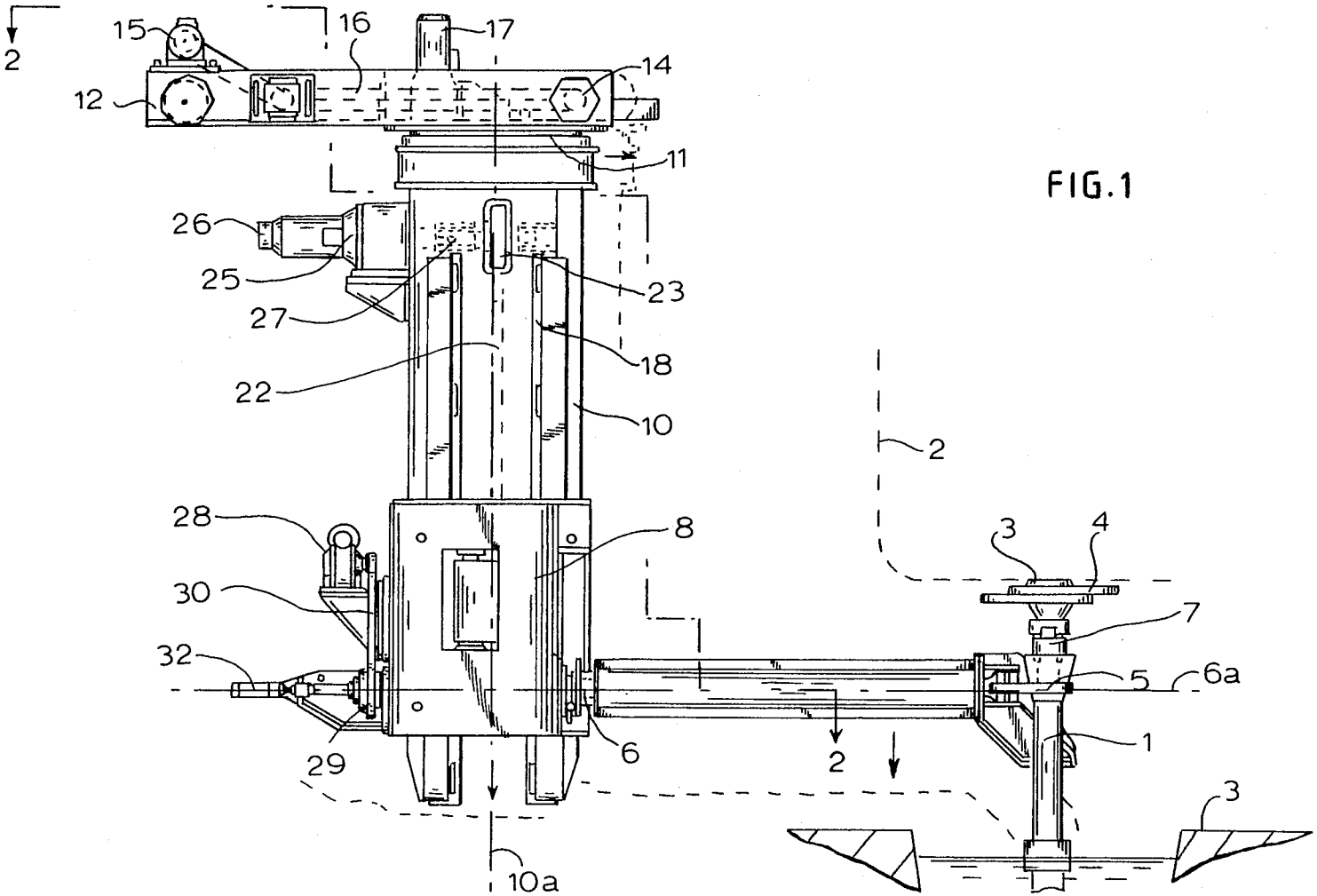

Referring now to the drawing, protective tube 1 for a jet of molten metal discharged from tap hole 3 of casting ladle 2 is shown in position under the tap hole or, more precisely under, and in alignment with, nozzle 7 through which the molten metal is discharged when slide valve 4 is open. The ladle constitutes a first container for the molten metal and molten metal distributor or tundish 3 under ladle 2 constitutes a second container which receives the discharged molten metal through protective tube 1 which is immersed in the molten metal in distributor 3. Slide valve system or gate 4 may be closed to prevent discharge of the molten metal from nozzle 7.

The manipulating apparatus for the protective tube comprises carrier arm 6 and means 5 on the carrier arm for gripping the protective tube. To replace and move the protective tube, a certain number of movements are indispensable, including a horizontal reciprocation of carrier arm 6, the rotation of the carrier arm around a vertical axis, the vertical reciprocation of the carrier arm and, preferably, the rotation of the carrier arm about the longitudinal axis thereof. Means for operating tube gripping means 5 are also required, as well as some degree of freedom in taking into account various positions of ladle 2, opening and closing tap hole gate system 4, and assuring the proper positioning of protective tube 1 under the jet of discharged molten metal or, more precisely, aligning the tube with nozzle 7.

For this purpose, the apparatus comprises first carriage 12 displaceable along horizontal track 13, vertical shaft 10 having longitudinal axis 10*a* and connected to first carriage 12 for displacement therewith, and means 11 comprised of gear means connecting the vertical shaft to the first carriage for rotating vertical shaft 10 about longitudinal axis 10*a* thereof. Second carriage 9 is vertically displaceable along the shaft and entrainment means 22–25 is operable to displace the second carriage vertically. Counterweight 24 maintains second carriage 9 in position when the entrainment means is not operated. Carrier arm 6 for protective tube 1 is supported on second carriage 9. In the illustrated embodiment, the apparatus further comprises support case 8 and connecting strut 19 pivots the support case to second carriage 9, carrier arm 6 being mounted on support case 8.

The horizontal reciprocation or displacement of tube carrier arm 6 is effected by first carriage 12. This carriage of welded construction is an automotive chassis mounted on rollers 14 running on track 13. Means is preferably provided for suspending the track so that the first carriage and the unit of elements connected thereto are suspended. Motor means 15 is mounted at one end of carriage 12 and power transmission chain 16 connects the motor means to rollers 14 at the opposite end of the carriage for rotating the rollers when displacement of the carriage along track 13 is desired.

Rotation of carrier arm 6 about vertical axis 10*a* is controlled by motor means 17 mounted on carriage 12 through gear means 11 interposed between shaft 10 and carriage 12. The shaft has guide rails for the vertical displacement of second carriage 9 therealong.

Figure 2:
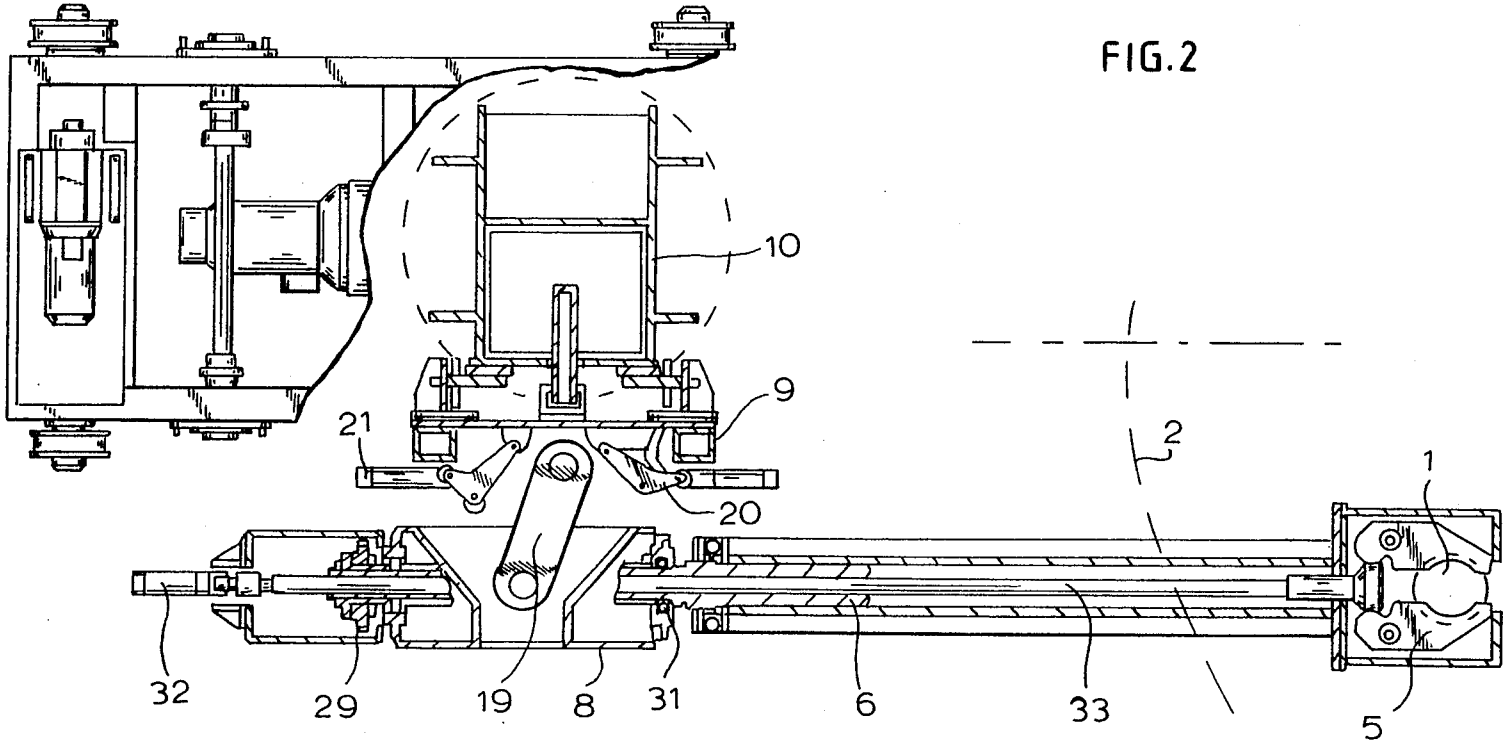
FIG. 2 is a section along line 2—2 of FIG. 1.
Figure 3:
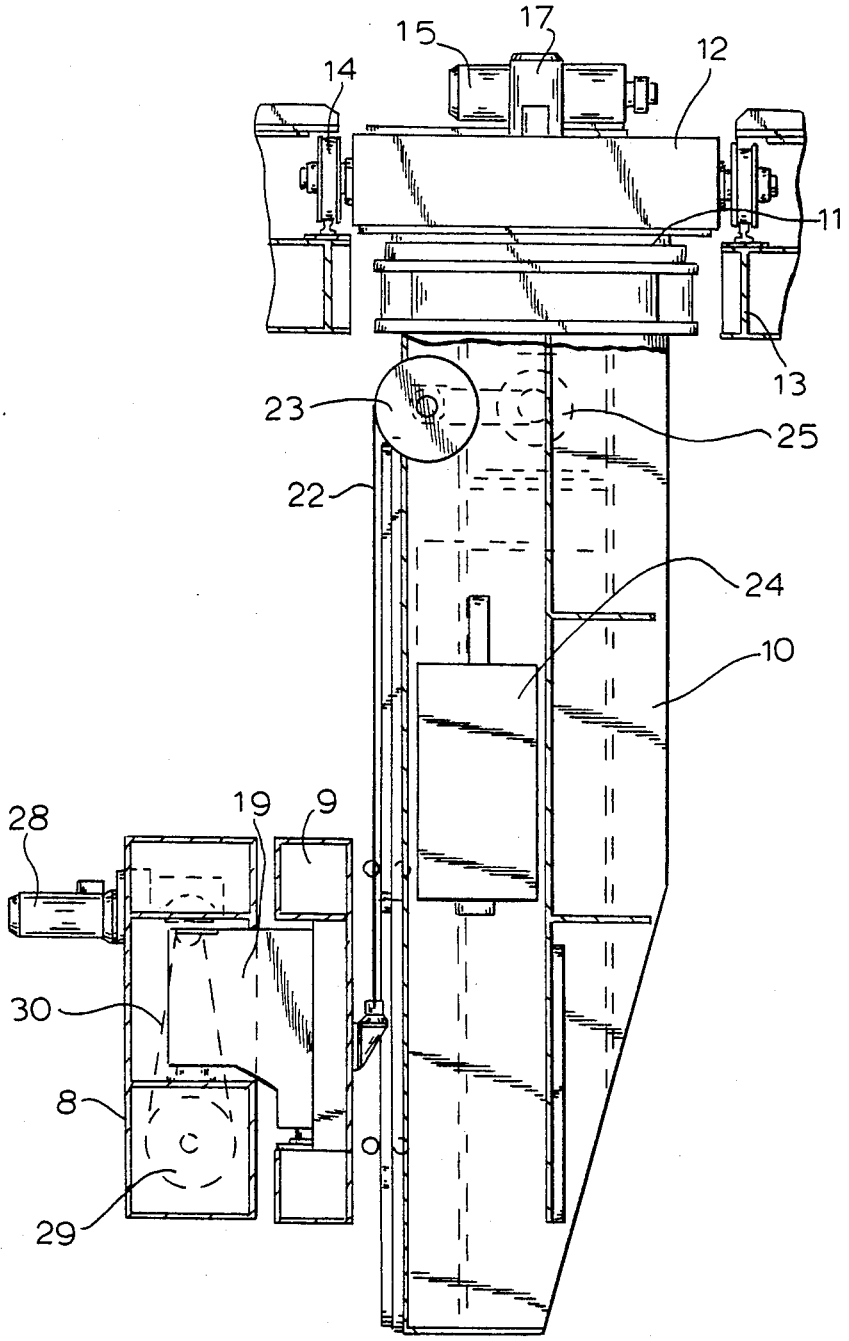
FIG. 3 is an end view of the apparatus.

Connecting strut 19 affixed to carriage 9 supports the unit consisting of support case 8 and carrier arm 6. To enable this unit to be locked in position during the manipulation of protective tube 1, selectively operative means locks the connecting strut in position. The illustrated means for locking the pivotal connecting strut in a predetermined pivotal position comprises two roller-carrying arms 20 (see FIG. 2) and pneumatic jacks 21 for moving the roller-carrying arms respectively into a locking position and an inoperative position, connecting strut 19 being arranged between the roller-carrying arms for engagement thereby. When the jacks are operated to engage the rollers of bell-crank lever arms 20 with connecting strut 19, support case 8 and attached tube carrier arm 6 will be held in a predetermined pivotal position. When the locking means is inoperative, during casting, it will define two end positions for pivoting the carrier arm so that there is some freedom for operating slide valve system 6 without in any way displacing the other components of the manipulating apparatus.

The vertical reciprocation or displacement of tube carrier arm 6 is obtained by second carriage 9. The illustrated entrainment means operable to displace carriage 9 vertically comprises chain 22 having one end affixed to carriage 9 and another end affixed to counterweight 24, drive gear 23, the chain being trained over the drive gear between the ends thereof. Motor means 25 is mounted on a support bracket on shaft 10 and brake means 26 and clutch means 27 connects motor means 25 to drive gear 23 for rotating the gear. During the casting, the clutch is released and protective tube 1 is applied to nozzle 7 solely by the force of counterweight 24. This provides an additional degree of freedom of movement.

Carrier arm 6 has longitudinal axis 6*a* and, in the illustrated embodiment, is rotatable about the longitudinal axis thereof. Gripping means 5 is arranged at one end of carrier arm 6 and entrainment means comprising motor means 28 and transmission chain 30 trained over gear 29 is arranged at an end of carrier arm 6 opposite to the one end for rotating the carrier arm. The carrier arm is journaled in two roller bearings 31 on support case 8 for rotation. This control provides an angular play of $\pm 5°$ with respect to the vertical position of protective tube 1, resulting in an added freedom of movement for the tube.

The illustrated tube gripping means is arranged at one end of carrier arm 6 and comprises a pair of clamps 5 operable to execute a pincer movement for gripping the tube therebetween. Means for operating the clamps comprises jack 32 arranged at an end of the carrier arm opposite to the one end to push rod 33 for opening the clamps.

As will be obvious from the above description of the tube manipulating apparatus, it will be capable to effecting all the services hereinabove described automatically, with the sole exception of the final positioning of the tube in alignment with nozzle 7, which requires a very brief human operation. To the extent that this is possible, sufficient lifting of ladle 2 for effecting the manipulation may be avoided by rotation of carrier arm 6, which causes tube 1 to pivot.

I claim:

1. An apparatus for manipulating a protective tube for a jet of a molten metal discharged from a tap hole of a casting ladle for placing the protective tube under the tap hole, maintaining the tube in place during a casting operation and removing the tube, which comprises (a) a first carriage displaceable along a horizontal track, (b) a vertical shaft having a longitudinal axis and connected to the first carriage for displacement therewith, (c) means for rotating the vertical shaft about the longitudinal axis thereof, (d) a second carriage vertically displaceable along the shaft, (e) a carrier arm for the protective tube supported on the second carriage, (f) support means connecting the carrier arm to the second carriage so as to allow free oscillatory horizontal movements of the carrier arm with respect to the second carriage, (g) means for locking the carrier arm in a predetermined position with respect to the second carriage, and (h) means on the carrier arm for gripping the protective tube.

2. The apparatus of claim 1, wherein the carrier arm has a longitudinal axis and is rotatable about the longitudinal axis thereof, the gripping means is arranged at one end of the carrier arm, and further comprising entrainment means arranged at an end of the carrier arm opposite to the one end for rotating the carrier arm.

3. The apparatus of claim 1, wherein the gripping means is arranged at one end of the carrier arm and comprises a pair of clamps, and further comprising means for operating the clamps arranged at an end of the carrier arm opposite to the one end.

4. The apparatus of claim 1, wherein the means for rotating the vertical shaft comprises gear means connecting the vertical shaft to the first carriage.

5. The apparatus of claim 1, further comprising entrainment means operable to displace the second carriage vertically and comprising a chain having one end affixed to the second carriage and another end affixed to a counterweight, a drive gear, the chain being trained over the drive gear between the ends thereof, motor means for driving the gear and clutch means connectng the motor means to the drive gear whereby the protective tube is maintained in position under the tap hole solely by the force of the counterweight when the clutch means is released.

6. The apparatus of claim 1, wherein said support means is constituted by a strut which enables the carrier arm to pivot about a vertical axis with respect to the second carriage.

7. The apparatus of claim 6, wherein the locking means comprises two roller-carrying arms and jacks for moving the roller-carrying arms respectively into a locking position and an inoperative position, the strut being arranged between the roller-carrying arms for engagement thereby when the arms are in the locking position.

8. The apparatus of claim 1, wherein said vertical shaft is suspended on said first carriage.

* * * * *